United States Patent [19]

Chikata et al.

[11] Patent Number: 4,743,132

[45] Date of Patent: May 10, 1988

[54] PAPER FEED DEVICE

[75] Inventors: Masaru Chikata; Takashi Yagi; Takeji Tsuchiya, all of Shizuoka, Japan

[73] Assignee: Tokyo Electric Co., Ltd., Tokyo, Japan

[21] Appl. No.: 50,575

[22] Filed: May 18, 1987

[30] Foreign Application Priority Data

May 20, 1985 [JP] Japan ..... 61-115421
Dec. 4, 1986 [JP] Japan ..... 61-289673

[51] Int. Cl.[4] ..... B41J 11/58; B41J 13/03

[52] U.S. Cl. ..... 400/629; 226/188; 271/3; 271/10; 400/625; 400/617

[58] Field of Search ..... 400/551, 617, 624, 625, 400/628, 629, 636, 637.1; 226/181, 188; 271/3, 9, 10

[56] References Cited

U.S. PATENT DOCUMENTS 4,053,092 10/1977 Edwards ..... 226/181 X
4,222,557 9/1980 Wu ..... 400/629 X
4,248,415 2/1981 Steinhilber ..... 271/9
4,269,522 5/1981 Levinson ..... 400/551 X
4,362,409 12/1982 Endo ..... 400/625
4,572,418 2/1986 Hirata ..... 226/188 X
4,577,984 3/1986 Yamamoto ..... 400/629 X
4,585,224 4/1986 Kuzuya ..... 400/624 X
4,606,663 8/1986 Christoph ..... 400/636 X
4,623,898 11/1986 Yamamoto ..... 400/637.1 X
4,627,607 12/1986 Ishii ..... 271/9 X
4,652,161 3/1987 Crean ..... 400/551 X

FOREIGN PATENT DOCUMENTS 586633 4/1979 Japan ..... 271/9

*Primary Examiner*—Paul T. Sewell
*Attorney, Agent, or Firm*—Oblon, Fisher, Spivak, McClelland & Maier

[57] ABSTRACT

A paper feed device of the invention comprises a transport gear connected in coaxial relationship to a transport roller interposed in a paper transporting route, a change-over arm which is rocked within a predetermined fixed range when the direction of rotation of a bidirectionally rotatable platen is reversed, and an idler gear mounted at a rocking free end of the change-over arm and connected to be normally rotated by power transmitted from the platen. The idler gear is selectively meshed with the transport gear in response to a rocking motion of the change-over arm, whereby a turning force of the platen is transmitted to the transport roller to transport paper only when the platen is rotated in one direction. Such a manner of transmission of rotation is attained without the necessity of a one-way clutch.

7 Claims, 4 Drawing Sheets

PAPER FEED DEVICE

FIELD OF THE INVENTION AND RELATED ART STATEMENT

This invention relates to a printer with a cut sheet feeder, and more particularly to a paper feed device thereof.

Some of conventional printers with a cut sheet feeder employ a structure wherein a turning force of a printer platen is used to feed paper. Japanese Patent Publication No. 58-6633 discloses an exemplary paper supply device of the structure. In the disclosed arrangement, a turning force of a platen in the reverse direction is utilized to drive a paper supply roller to feed one of cut sheets of paper within a paper tray first to a position at which the platen is in contact with a pinch roller. Then the platen is rotated in the forward direction to feed the cut paper sheet to a printing station, whereafter the cut paper sheet may be fed line by line or in some other manner. Upon such forward rotation of the platen, transmission of power to the paper supply roller is interrupted. As structural means therefor, a one-way clutch may be interposed in a power transmission route to the paper supply roller.

Meanwhile, an exemplary device for discharging paper is shown in FIG. 7. The device shown includes a take-up roller 101 which is rotated in the same direction with a platen 100 by power transmitted thereto from the platen 100. A one-way clutch 102 is interposed in a power transmission route from the platen 100 to the take-up roller 101 so that only a turning force of the platen 100 in the forward direction may be transmitted to the take-up roller 101. An auxiliary roller 104 is located so as to cooperate with the take-up roller 101 to hold therebetween paper 103 fed thereto from the platen 100. A stocker 105 is located so as to receive therein paper 103 fed by the auxiliary roller 104 and the take-up roller 101. It is to be noted that a feed roller not shown for feeding paper to the platen 100 is connected to receive power transmitted from the platen 100 to feed paper only when the platen 100 is rotated in the reverse direction.

In the arrangement of the construction described above, when the platen 100 is rotated in the forward direction, power of the platen 100 is transmitted to the take-up roller 101 to discharge paper 103. In this instance, before paper 103 is completely discharged into the stocker 105, the platen 100 is rotated in the reverse direction to transmit its power to the feed roller. This is intended to save a paper transporting time occupied in a printing time to attain an efficient printing operation. Here, when the platen 100 is rotated in the reverse direction, transmission of power to the take-up roller 101 is interrupted by an action of the one-way clutch. Consequently, even though the platen 100 is rotated in the reverse direction, paper 103 is prevented from being fed in the opposite direction from the take-up roller 101.

Problems of the prior art described above will now be described. In a device which feeds paper in such a manner as described above, when paper is to be fed by a platen which rotates in the forward direction, a one-way clutch is necessitated in order to interrupt transmission of power to a paper feed roller. Accordingly, it is a drawback that a construction for a power transmission route is complicated. Besides, since a one-way clutch is expensive, employment of it will result in high production cost.

Further, in the device shown in FIG. 7 which is designed to discharge paper, when the platen 100 is rotated in the reverse direction to feed paper 103 to a printing position, the one-way clutch 102 is still necessitated in order to interrupt transmission of power to the take-up roller 101, which will raise similar problems. In this case, the one-way clutch 102 may not be necessitated if the platen 100 is rotated in the reverse direction after paper 103 has been discharged completely into the stocker 105, which, however, will elongate the paper transporting time.

OBJECTS AND SUMMARY OF THE INVENTION

It is a first object of the invention to provide a paper feed device of the type wherein a drive mechanism for a platen is used to drive a mechanism for feeding paper, wherein the construction of a power transmission route can be simplified.

It is a second object of the invention to provide a paper feed device of the type wherein a drive mechanism for a platen is used to drive a mechanism for feeding paper, which can be produced at a reduced production cost.

It is a third object of the invention to provide a paper feed device of the type wherein a drive mechanism for a platen is used to drive a mechanism for feeding paper, wherein the paper feeding time can be reduced.

In order to attain the objects, according to the present invention, a paper feed device comprises a transport gear connected in a coaxial relationship to a transport roller for transporting paper, the transport roller being interposed in a paper transporting route, a change-over arm for following a rotating motion of a bidirectionally rotatable platen to make a rocking motion within a predetermined fixed range after the direction of rotation of the platen is reversed, and an idler gear located at a rocking free end of the change-over arm and connected to be normally rotated by power transmitted from the platen, the idler gear being selectively brought into meshed engagement with the transport gear in response to a rocking motion of the change-over arm. Accordingly, only when the platen is rotated in one direction, a turning force of the platen is transmitted to the transport roller to transport paper. Thus, if the mechanism is employed in a paper supply apparatus, it will operate as a paper supply mechanism, but on the contrary if it is employed in a paper discharging apparatus, it will operate as a paper discharging mechanism. In either case, no one-way clutch is necessitated in a power transmission route, which will allow realization of simplification in structure and reduction in production cost of a paper feed device.

DESCRIPTION OF THE PREFERRED EMBODIMENTS

Figure 1:
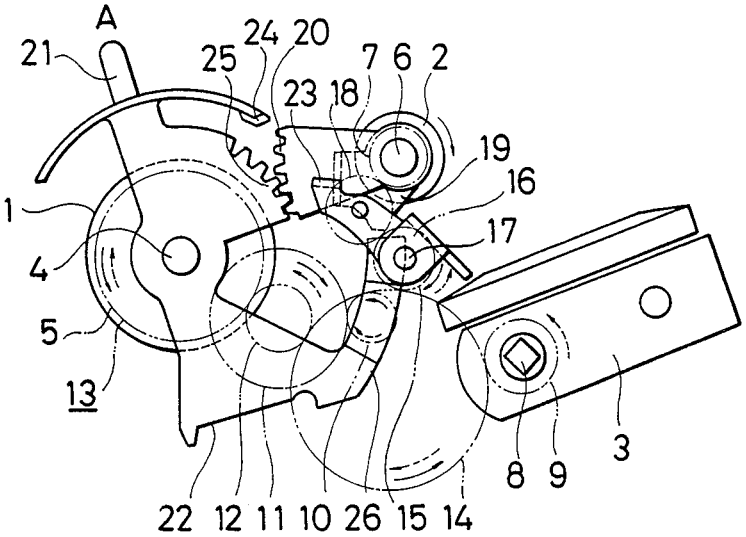
FIG. 1 is a side elevational view illustrating a power transmission route in a paper supply mechanism according to a first embodiment of the present invention

A paper feed device of a first embodiment of the present invention will now be described with reference to FIGS. 1 to 4. The paper feed device of the embodiment is incorporated as a paper supply mechanism, and accordingly a transport roller is formed as a paper supply roller 2, and a transport gear is formed as a roller gear 7. At first, a power transmission route to a platen and another power transmission route to a tractor 3 will be described with reference to FIG. 1. A platen gear 5 is secured to a platen shaft 4 which is connected to rotate in an integral relationship with the platen 1. The roller gear 7 is secured at an end of a roller shaft 6 which is connected to rotate in an integral relationship with the paper supply roller 2. A tractor gear 9 is secured at an end portion of an input power shaft 8 of the tractor 3.

A motor gear 10 is directly connected to a reversible or bidirectional motor not shown and is in mesh with one 11 of a pair of gears 11, 12 which are mounted in a concentric, mutually fixed relationship to each other while the platen gear 5 is in mesh with the other gear 12, thereby constituting a platen driving mechanism 13. Meanwhile, a slide gear 14 is mounted in normally meshed engagement with the gear 12 and for sliding movement in a direction of an axis thereof so as to selectively mesh with the tractor gear 9. Further, a fulcrum gear 15 is supported on a fulcrum shaft 17 and is held in normally meshed engagment with the slide gear 14. A change-over arm 16 is also supported on the fulcrum shaft 17 such that it may follow the fulcrum gear 15 due to frictional contact of a side face thereof with the fulcrum gear 15. An idler gear 18 is supported for rotation at a free end of the change-over arm 16 and is held in normally meshed engagement with the fulcrum gear 15. However, as the change-over arm 16 makes a rocking motion, the idler gear 18 is selectively meshed with the roller gear 7.

Figure 2:
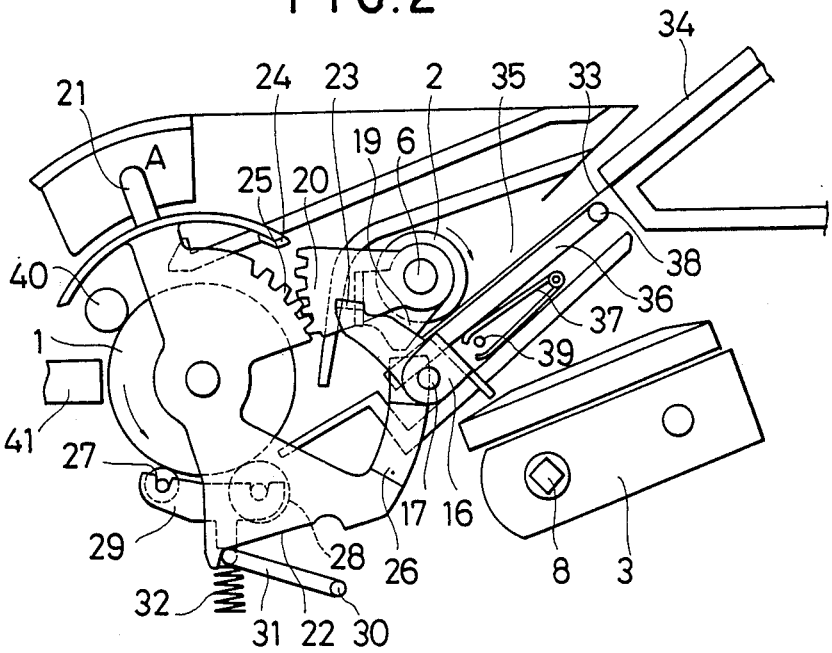
FIG. 2 is a side elevational view showing the paper supply mechanism of FIG. 1 when a sheet of paper is fed by a paper supply roller.
Figure 3:
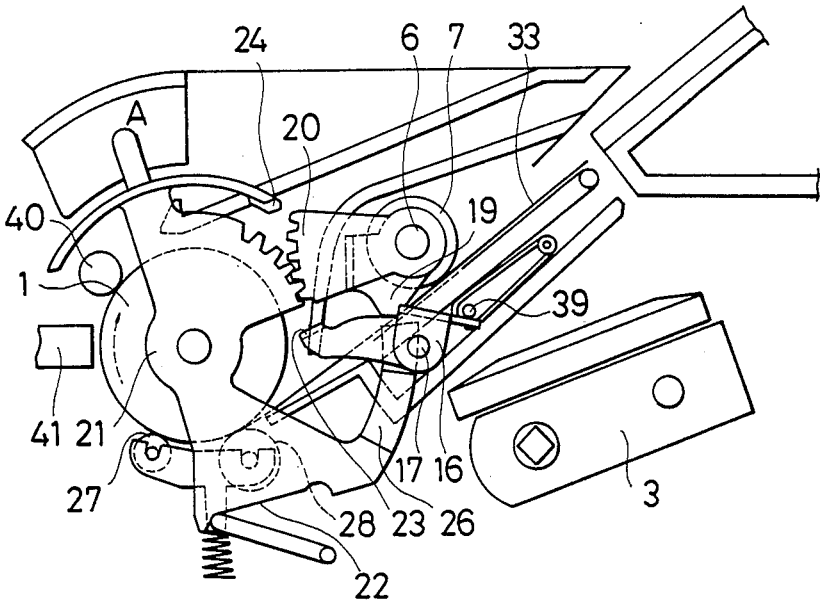
FIG. 3 is a side elevational view showing the paper supply mechanism of FIG. 1 when power to the paper supply roller is interrupted.
Figure 4:
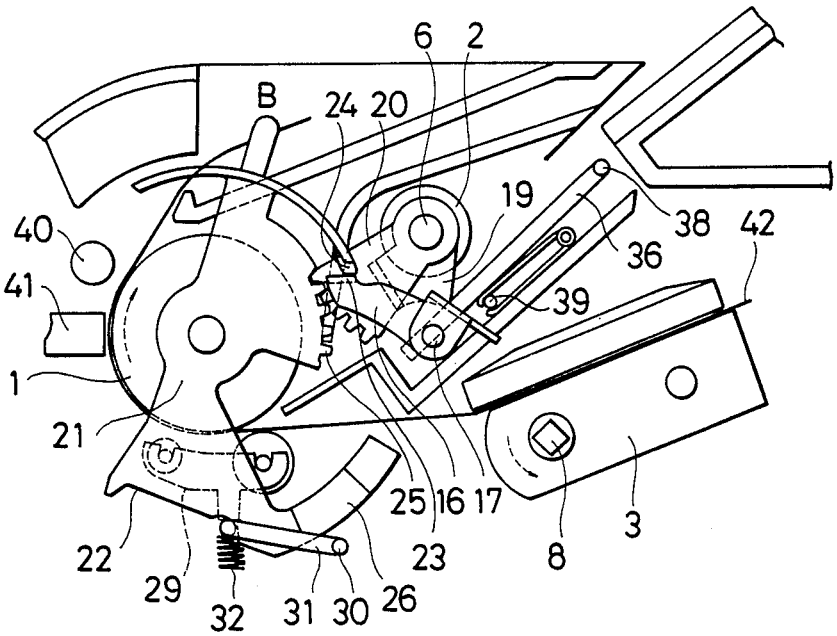
FIG. 4 is a side elevational view showing the paper supply mechanism of FIG. 1 when a web of paper is fed by means of a paper tractor.

A set gear 20 having a cam 19 thereon is supported for rotation at an end portion of the roller shaft 6. A release lever 21 is fitted on the platen shaft 4 for pivotal motion from and to predetermined positions at which it can be selectively fixed. The predetermined positions here include a friction feed position A as seen in FIGS. 1 to 3 and a tractor feed position B as seen in FIG. 4. The release lever 21 has formed thereon a cam face 22 for moving a pinch roller which will be hereinafter described away from the platen 1 and a change-over arm pressing portion 24 for pressing against an end 23 of the change-over arm 16 when the release lever 21 is pivoted to the tractor feed position B. The release lever 21 further has formed thereon a sector gear 25 for engagement with the set gear 20 and a pressing piece 26 which opposes to an inner side face of the slide gear 14. The slide gear 14 is urged toward the pressing piece 26 which is located inside thereof, and the pressing piece 26 is shaped so as to be tapered axially inwardly of the platen 1 in the clockwise direction. In particular, when the release lever 21 is positioned at the friction feed position A as shown in FIGS. 1, 2 and 3, the slide gear 14 is pressed by a most outwardly projected portion of the pressing piece 26 of the release lever 21 and held at its outermost position at which it is out of meshed engagement with the tractor gear 9, but on the contrary when the release lever 21 is moved to the tractor feed position B as shown in FIG. 4, the slide gear 14 is slidably moved axially inwardly by the aforementioned urging force to its innermost position at which it is borne by an innermost portion of the pressing piece 26 and is thus meshed with the tractor gear 9.

Referring now to FIGS. 2 to 4, a pair of pinch rollers 27, 28 are mounted for rotation on a roller guide 29 which is located below the platen 1 and supported at an end of a wire 31 mounted for pivotal motion around a fulcrum 30 provided by the other end of the wire 31. The wire 31 and the roller guide 29 are normally urged toward the platen 1 by a spring 32.

A set plate 36 is interposed in a sheet feeding route 35 along which a sheet 33 of paper is fed to the platen 1 from a sheet tray 34 in which sheets 33 of paper are stored in a heap. The set plate 36 is located in an opposing relationship to a lower face of the paper supply roller 2 and is mounted for up and down pivotal motion on a support shaft 38. The set plate 36 is normally urged upwardly by a spring plate 37. A stopper 39 for limiting a range of pivotal motion of the change-over arm 16 is located on a side wall of the set plate 36.

Of the construction described above, a power transmitting operation will first be described. It is to be noted that, of arrow marks which indicate directions of rotation of the individual gears, those shown in broken lines relate to the forward directions while those shown in solid lines relate to the reverse directions of rotation. Rotation of the motor gear 10 is transmitted to the platen 1 via a route of the gear 11, gear 12 and platen gear 5. Meanwhile, rotation transmitted from the gear 12 to the slide gear 14 is further transmitted to the fulcrum gear 15 and then to the idler gear 18 from which it may be selectively transmitted to the roller gear 7 so that it may be finally transmitted to the paper supply roller 2. Rotation of the slide gear 14 may also be transmitted selectively to the tractor gear 9.

If the release lever 21 is pivoted to the tractor feed position B as shown in FIG. 4, the cam face 22 of the release lever 21 presses against the wire 21 so that the roller guide 29 is moved down by its own weight thereby to move the pinch rollers 27, 28 away from the platen 1. Meanwhile, since the change-over arm pressing portion 24 of the release lever 21 presses against the change-over arm 16 to pivot in the counterclockwise direction, the idler gear 18 is brought out of meshed engagement with the roller gear 7, thereby interrupting transmission of power to the paper supply roller 2. Further, as the sector gear 25 of the release lever 21 is pivoted, the set gear 20 is pivoted in the counterclockwise direction together with the cam 19 so that the cam 19 moves the set plate 36 away from the paper supply roller 2. In this condition, sheets 33 of paper may be set in position in the sheet tray 34.

Then, if the release lever 21 is pivoted back to the friction feed position A again, the wire 31 and the roller guide 29 are allowed to be moved up by the urging force of the spring 32 to bring the pinch rollers 27, 28 into contact with an outer periphery of the platen 1.

Meanwhile, as the sector gear 25 of the release lever 21 is pivoted, the set gear 20 is pivoted in the clockwise direction together with the cam 19 so that the set plate 36 is released from the cam 19 and is thus moved by the urging force of the spring plate 37 to press the sheets 33 of paper against the paper supply roller 2. As described hereinbefore, transmission of power to the tractor gear 9 is interrupted when the release lever 21 is positioned at the friction feed position A. Thus, if the platen 1 is rotated in the reverse direction is such a condition as shown in FIG. 2, the fulcrum gear 15 will be rotated in a direction indicated by an arrow mark of a solid line (in the clockwise direction) so that the change-over arm 16 will be pivoted in the clockwise direction by a frictional force thereof with a side face of the fulorum gear 15 until the idler gear 18 thereon is brought into meshed engagement with the roller gear 7. Accordingly, the paper supply roller 2 can be rotated in the clockwise direction by a driving force which is provided by rotation of the platen 1 in the reverse direction. Consequently, the sheet 33 of paper on the set plate 36 will be fed to a position of contact between the platen 1 and the pinch rollers 27, 28, and then at a time when a predetermined number of steps is counted, the motor which drives the motor gear 10 is stopped.

Then, if the platen 1 is rotated in the forward direction as shown in FIG. 3, the sheet 33 of paper is fed toward a printing station 41. In this instance, the fulcrum gear 15 is rotated but in the counterclockwise direction as indicated by an arrow mark of a broken line in FIG. 1. Accordingly, the change-over arm 16 follows the fulcrum gear 15 to pivot in the counterclockwise direction until the set plate 36 is stopped by the stopper 39, and consequently the idler gear 18 on the change-over arm 16 is spaced away from the roller gear 7. In this manner, a power interrupting condition can be reached between the platen driving mechanism 13 and the paper supply roller 2.

Since the paper supply roller 2 can be selectively and automatically coupled to the platen driving mechanism 13 by pivotal motion of the change-over arm 16 in a direction corresponding to a direction of rotation of the platen 1 in this manner, a one-way clutch can be omitted from the power transmission route to the paper supply roller 2, which will allow simplification in structure of the arrangement. At the same time, production cost can be reduced because a one-way clutch which itself is expensive is not necessitated.

Now, a tractor feeding operation will be described. At first, the release lever 21 is pivoted to the tractor feed position B as shown in FIG. 4. In this instance, the pinch rollers 27, 28 are displaced away from the platen 1 while transmission of power to the paper supply roller 2 is interrupted as described hereinabove, and the pressing piece 26 of the release lever 21 is moved away from the slide gear 14 so that the slide gear 14 is allowed to be slidably moved into meshed engagement with the tractor gear 9 by the aforementioned urging force. Then, while the platen 1 is held in its stopped condition, a web 42 of paper is set in position in the tractor 3 and is thus inserted between the platen 1 and the pinch rollers 27, 28, and then the platen 1 is rotated in the clockwise direction. Consequently, the input power shaft 8 is rotated in the counterclockwise direction so that the paper web 42 is pushed forward and thus fed below the platen 1. It is to be noted that when paper is to be fed by the tractor 3 in this manner, a paper bail roller 40 may be moved away from the platen 1 in advance.

Now, a second embodiment of the present invention will be described with reference to FIGS. 5 and 6. The embodiment shown is in the form of a paper discharging mechanism. The paper discharging mechanism shown includes a platen 50 connected to be driven to rotate in forward and reverse directions by a motor not shown. A platen gear 52 is connected to the platen 50 in a coaxial relationship to a platen shaft 51 of the platen 50. A pair of pinch rollers 53, 54 are mounted below the platen 50 for contacting with an outer periphery of the platen 50. A paper supply roller 57 is located for transporting an uppermost one of sheets 56 of paper accumulated in a paper holder 55 toward a position between the platen 50 and the pinch rollers 53, 54. The paper supply roller 57 is connected to the platen 50 such that power may be transmitted thereto from the latter only when the platen 50 is rotated in the reverse direction.

Meanwhile, around the platen 50, a print head 58 is located at a position rearwardly of the pinch rollers 53, 54 along a paper transporting route and in an opposing relationship to the platen 50, and a guide wall 59 is located at a further rearward position along the paper transporting route for guiding a sheet 56 of paper discharged from the platen 50 to a predetermined route. A take-up roller 61 is arranged in contact with the guide wall 59 for transporting a sheet 56 of paper discharged from the platen 50 to a stocker 60 located at a rearmost position of the paper transporting route. A center shaft 62 of the take-up roller 61 extends in a parallel relationship to the platen shaft 51. A take-up gear 63 is connected to the center shaft 62 of the take-up roller 61 and located in the same vertical plane with the platen gear 52.

Meanwhile, a change-over lever 64 is mounted for pivotal motion on the platen shaft 51 and held in contact with a side face of the platen gear 52. A pivoting free end **64*a* of the change-over lever 64 extends between the print head 58 and the take-up roller 61, and an idler gear 65 is mounted for rotation at the pivoting free end 64*a* of the change-over lever 64. The idler gear 65 is in normally meshed engagement with the platen gear 52 and is positioned such that it may be meshed with the take-up gear 63 when the change-over lever 64 is pivoted to the take-up gear 63**.

Figure 5:
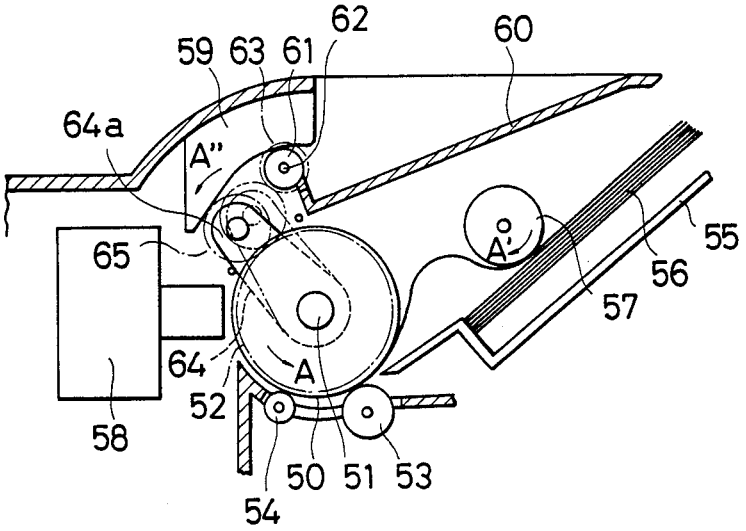
FIG. 5 is a side elevational view of a paper discharging mechanism according to a second embodiment of the invention when paper is supplied.
Figure 6:
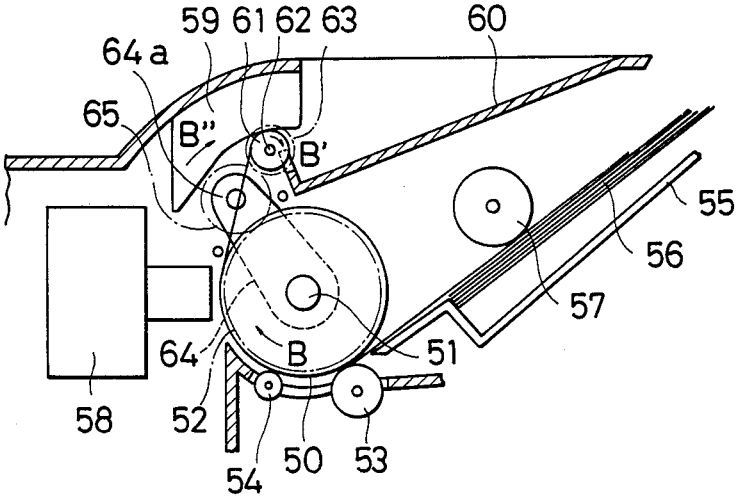
FIG. 6 is a side elevational view showing the paper discharging mechanism when paper is discharged.
Figure 7:
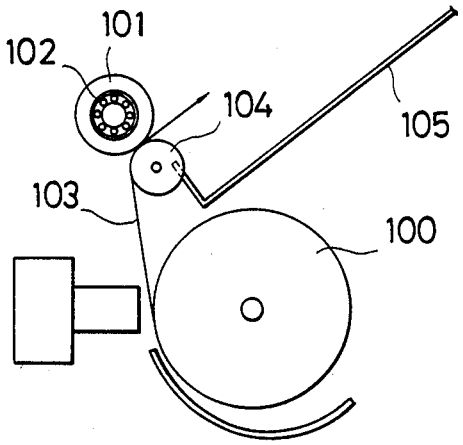
FIG.7 PRIOR ART
FIG. 7 is a side elevational view of an exemplary conventional paper discharging mechanism.

With the construction described above, if the platen 50 is rotated in the reverse direction, that is, in a direction indicated by an arrow mark A in FIG. 5, power of the platen 50 is transmitted to rotate the paper supply roller 57 in a direction indicated by another arrow mark A' to feed an uppermost one of the sheets 56 of paper from the paper holder 55 to the platen 50. In this instance, the change-over lever 64 follows the platen 50 to pivot in the same direction due to a frictional force caused by contact thereof with the platen 50. Accordingly, the idler gear 65 mounted at the pivoting free end **64*a* of the change-over lever 64 is displaced away from the take-up gear 63, thereby interrupting transmission of power to the take-up roller 61**.

Meanwhile, if a new sheet 56 of paper is supplied to the platen 50, the platen 50 is subsequently rotated in the forward direction, that is, in a direction indicated by an arrow mark B in FIG. 6, to feed the paper sheet 56 to a printing position at which the paper sheet 56 opposes to the print head 58, whereafter the paper sheet 56 may be fed line by line by the platen 50. In this instance, the change-over lever 64 which follows the platen 50 pivots in the same direction with the platen 50, and accordingly the idler gear 65 thereon is now brought into meshed engagement with the take-up gear 63. Consequently, power is transmitted from the platen gear 52 to the idler gear 65 and then to the take-up gear 63 so that the take-up roller 61 is rotated in a direction indicated by an arrow mark B' in FIG. 6. Accordingly, the printed paper sheet 56 transported from the platen 50 and guided to the take-up roller 61 by the guide wall 59 is now transported by the take-up roller 61 and thus discharged into the stocker 60.

In the course of the printed paper sheet 56 being discharged into the stocker 60, the direction of rotation of the platen 50 is reversed before the paper sheet 56 has been completely discharged from into the stocker 60. In particular, just after printing of the paper sheet 56 has been completed, the platen 50 is rotated in the reverse direction in order to supply a new sheet 56 of paper from the paper holder 55. This is intended to omit a time required before a paper sheet 56 is completely discharged into the stocker 60 after completion of printing of the paper sheet 56 and thereby to minimize an overall printing time. In this instance, as the platen 50 is rotated in the reverse direction, transmission of power to the take-up roller 61 is interrupted. Accordingly, even if a paper supply operation is performed before a paper sheet 56 has been discharged completely, the sheet 56 of paper being discharged will not be moved in the opposite direction at all. As a result, the efficiency in transportation of a sheet 56 of paper in a printing procedure can be raised.

What is claimed is:

1. A paper feed device, comprising:

a transport gear connected in a coaxial relationship to a transport roller for transporting paper, said transport roller being interposed in a paper transporting route;

a change-over arm for following a rotating motion of a bidirectionally rotatable platen to make a rocking motion within a predetermined fixed range after the direction of rotation of said platen is reversed; and an idler gear mounted for rotation at a rocking free end of said change-over arm and connected to be normally rotated by power transmitted from said platen, said idler gear being selectively brought into meshed engagement with said transport gear in response to a rocking motion of said change-over arm.

2. A paper feed device according to claim 1, wherein said transport roller is a paper discharging take-up roller interposed in a paper sheet discharging route while said transport gear is a take-up gear; and a platen gear is connected in a coaxial relationship to said platen and is held in normally meshed engagement with said idler gear, and said change-over arm is mounted for rotation on a platen shaft of said platen.

3. A paper feed device according to claim 1, wherein said transport roller is a paper supply roller interposed in a paper sheet feeding route while said transport gear is a roller gear; a platen gear is connected in a coaxial relationship to said platen, and a platen driving mechanism consisting of a plurality of gears is provided for transmitting rotation of a bidirectional motor to said platen gear; and a fulcrum gear is provided for receiving rotation from said platen driving mechanism and is held in normally meshed engagement with said idler gear, and said change-over arm is mounted for rotation around an axis of said fulcrum gear and is held in contact with a side face of said fulcrum gear with a frictional force sufficient for said change-over arm to follow rotation of said fulcrum gear to make a rocking motion.

4. A paper feed device according to claim 3, wherein a stopper is provided for limiting a rocking motion of said change-over arm in a direction opposite to the direction in which said change-over arm is pivoted to bring said idler gear thereon into meshed engagement with said roller gear.

5. A paper feed device, comprising:

a roller gear connected to a paper feed roller interposed in a paper sheet feed route;

a platen gear connected to a platen with which a pinch roller is resiliently contacted;

a platen driving mechanism including a plurality of gears for transmitting rotation of a bidirectional motor to said platen gear;

a fulcrum gear for receiving rotation of said platen driving mechanism;

a change-over arm for following rotation of said fulcrum gear to make a rocking motion due to frictional contact thereof with a side face of said fulcrum gear, said change-over arm having a stopping position in one direction of rocking movement thereof defined by a stopper;

an idler gear mounted for rotation at a rocking free end of said change-over arm and located in normally meshed engagement with said fulcrum gear for transmitting rotation of said fulcrum gear to said roller gear only when said platen is rotated in the reverse direction in accordance with a rocking motion of said change-over arm;

a release lever mounted for pivotal motion for selectively moving said pinch roller away from said platen, said release lever being able to be fixed at a selected position; and a change-over arm pressing means formed on said release lever for pressing said change-over arm toward and against said stopper when said release lever is pivoted in a direction to move said pinch roller away from said platen.

6. A paper feed device, comprising:

a roller gear connected to a paper feed roller interposed in a paper sheet feed route;

a platen gear connected to a platen with which a pinch roller is resiliently contacted;

a platen driving mechanism including a plurality of gears for transmitting rotation of a bidirectional motor to said platen gear;

a fulcrum gear for receiving rotation of said platen driving mechanism;

a change-over arm for following rotation of said fulcrum gear to make a rocking motion due to frictional contact thereof with a side face of said fulcrum gear, said change-over arm having a stopping position in one direction of rocking movement thereof defined by a stopper;

an idler gear mounted for rotation at a rocking free end of said change-over arm and located in normally meshed engagement with said fulcrum gear for transmitting rotation of said fulcrum gear to said roller gear to rotate said roller gear in the forward direction only when said platen is rotated in the reverse direction in accordance with a position of said change-over arm;

a set plate mounted for displacement downwardly from a lower face of said paper feed roller and urged toward said paper feed roller to contact sheets of paper supported thereon with the lower face of said paper feed roller;

a set gear having an integral cam located in an opposing relationship to an upper face of said set plate, said set gear being mounted for integral rotation with said cam to move said cam into and out of engagement with the upper face of said set plate;

a release lever mounted for pivotal motion for selectively moving said pinch roller away from said platen, said release lever being able to be fixed at a selected position; and a sector gear formed on said release lever for meshing engagement with said set gear to press said cam against said set plate as said release lever is pivoted.

7. A paper feed device, comprising:

a roller gear connected to a paper feed roller interposed in a paper sheet feed route;

a platen gear connected to a platen with which a pinch roller is resiliently contacted;

a platen driving mechanism including a plurality of gears for transmitting rotation of a bidirectional motor to said platen gear;

a fulcrum gear for receiving rotation of said platen driving mechanism;

a change-over arm for following rotation of said fulcrum gear to make a rocking motion due to frictional contact thereof with a side face of said fulcrum gear, said change-over arm having a stopping position in one direction of rocking movement thereof defined by a stopper;

an idler gear mounted for rotation at a rocking free end of said change-over arm and located in normally meshed engagement with said fulcrum gear for transmitting rotation of said fulcrum gear to said roller gear only when said platen is rotated in the reverse direction in accordance with a rocking motion of said change-over arm;

a tractor gear connected in a coaxial relationship to an input power shaft of a tractor provided for transporting a continuous web of paper to said platen;

a slide gear connected to normally receive rotation of said platen driving mechanism and mounted for sliding movement to selectively engage with said tractor gear;

a release lever mounted for pivotal motion for selectively moving said pinch roller away from said platen, said release lever being able to be fixed at a selected position; and a pressing element formed on said release lever for pressing against said slide gear to slidably move said slide gear into meshed engagement with said tractor gear when a face of said pressing element perpendicular to an axis of a pivotal motion of said release lever is displaced in a direction of the axis of pivotal motion of said release lever as said release lever is pivoted in a direction to move said pinch roller away from said platen; and a change-over arm pressing means formed on said release lever for pressing said change-over arm toward and against said stopper when said release lever is pivoted in the direction to move said pinch roller away from said platen.

* * * * *

UNITED STATES PATENT AND TRADEMARK OFFICE

CERTIFICATE OF CORRECTION

PATENT NO. : 4,743,132

DATED : May 10, 1988

INVENTOR(S) : Masaru Chikata, et al.

It is certified that error appears in the above-identified patent and that said Letters Patent is hereby corrected as shown below: Title page:

The first entry under [30] Foreign Application Priority Data should be corrected as follows:

-- May 20, 1986 [JP] Japan ..... 61-115421 --

Signed and Sealed this

Twentieth Day of September, 1988

*Attest:*

DONALD J. QUIGG

*Attesting Officer*

*Commissioner of Patents and Trademarks*